US010490167B2

(12) United States Patent
Cianfrone

(10) Patent No.: US 10,490,167 B2
(45) Date of Patent: Nov. 26, 2019

(54) TECHNIQUES FOR IMAGE ENHANCEMENT USING A TACTILE DISPLAY

(71) Applicant: INTEL CORPORATION, Santa Clara, CA (US)

(72) Inventor: Joseph A. Cianfrone, San Jose, CA (US)

(73) Assignee: INTEL CORPORATION, Santa Clara, CA (US)

( * ) Notice: Subject to any disclaimer, the term of this patent is extended or adjusted under 35 U.S.C. 154(b) by 302 days.

(21) Appl. No.: 14/224,939

(22) Filed: Mar. 25, 2014

(65) Prior Publication Data

US 2015/0279010 A1 Oct. 1, 2015

(51) Int. Cl.
*G09G 5/36* (2006.01)
*G09G 5/00* (2006.01)
(Continued)

(52) U.S. Cl.
CPC ..... *G09G 5/363* (2013.01); *G09G 3/3433* (2013.01); *G09G 3/3493* (2013.01); *G09G 5/003* (2013.01); *G09G 5/02* (2013.01); *G09G 2320/0242* (2013.01); *G09G 2320/066* (2013.01); *G09G 2320/0626* (2013.01); *G09G 2320/0666* (2013.01); *G09G 2340/14* (2013.01)

(58) Field of Classification Search
CPC ..... G06F 3/0488; G06F 3/044; G06F 3/0421; G06T 11/001; G06T 15/04; G09G 5/02; G08B 6/00
USPC ..... 345/156, 173, 174, 175, 176, 178, 581, 345/582, 585, 589, 591, 592, 593, 594; 340/407.1
See application file for complete search history.

(56) References Cited

U.S. PATENT DOCUMENTS 3,594,787 A * 7/1971 Ickes ..... G09B 21/003 340/407.2
5,835,255 A 11/1998 Miles
(Continued)

OTHER PUBLICATIONS

Takashima, K., Yoshinaka, K., Okazaki, T., & Ikeuchi, K. (2005), "An Endoscopic Tactile Sensor for Low Invasive Surgery", Sensors and Actuators A: Physical, 119(2), pp. 372-383.*
(Continued)

*Primary Examiner* — Sarah Lhymn
(74) *Attorney, Agent, or Firm* — Finch & Maloney PLLC

(57) ABSTRACT

Techniques are disclosed for enhancing the quality of a displayed image using a tactile or other texture display. In particular, the disclosed techniques leverage active-texture display technology to enhance the quality of graphics by providing, for example, outlining and/or shading when presenting a given image, so as to create the effect of increased contrast and image quality and/or to reduce observable glare. These effects can be present even at high viewing angles and in environments of high light reflection. To these ends, one or more graphics processes, such as edge-detection and/or shading, may be applied to an image to be displayed. In turn, an actuator element (e.g., microelectromechanical systems, or MEMS, devices) of the tactile display may be manipulated (e.g., in Z-height) to provide fine-grain adjustment of image attributes such as: pixel brightness/intensity; pixel color; edge highlighting; object outlining; effective shading; image contrast; and/or viewing angle.

25 Claims, 10 Drawing Sheets

(51) Int. Cl.
*G09G 5/02* (2006.01)
*G09G 3/34* (2006.01)

(56) References Cited

U.S. PATENT DOCUMENTS

| | | | | |
|---|---|---|---|---|
| 8,884,880 | B2 | 11/2014 | Lim et al. | |
| 9,030,308 | B1 * | 5/2015 | Buuck | G06F 3/0488 340/407.2 |
| 2008/0150911 | A1 * | 6/2008 | Harrison | 345/173 |
| 2009/0002328 | A1 * | 1/2009 | Ullrich et al. | 345/173 |
| 2009/0130639 | A1 | 5/2009 | Skinner | |
| 2010/0238114 | A1 * | 9/2010 | Vartanian | G06F 3/016 345/168 |
| 2011/0316798 | A1 | 12/2011 | Jackson et al. | |
| 2011/0316828 | A1 * | 12/2011 | Shirbabadi | G06F 1/1603 345/207 |
| 2012/0098789 | A1 | 4/2012 | Ciesla et al. | |
| 2012/0134024 | A1 * | 5/2012 | Lander | C03C 15/00 359/599 |
| 2012/0261551 | A1 * | 10/2012 | Rogers | G02B 3/14 250/208.1 |
| 2013/0342466 | A1 | 12/2013 | Ciesla | |
| 2014/0098075 | A1 * | 4/2014 | Kwak | G06F 3/0487 345/204 |

OTHER PUBLICATIONS

Wikipedia, "Electroactive polymers," Feb. 10, 2014, 9 pages. Retrieved from: http://en.wikipedia.org/w/index.php?oldid=594853911.

Williams, Martyn, "Eyes-on: Sharp's next-gen MEMS display technology," Sep. 30, 2013, 2 pages. Retrieved from: http://www.techhive.com/article/2050600/sharp-shows-7inch-nextgeneration-mems-display.html.

Faraj et al., "Optical and Structural Properties of Thermally Evaporated Zinc Oxide Thin Films on Polyethylene Terephthalate Substrates," Hindawi Publishing Corporation, International Journal of Polymer Science,vol. 2011, Article ID 302843, Sep. 8, 2011, 5 pages.

Wikipedia, "Interferometric Modulator Display," Jan. 31, 2014, 3 pages. Retrieved from: http://en.wikipedia.org/w/index.php?oldid=593289681.

Mirasol, "Competitive Display Technologies—White Paper," Jun. 2009, 20 pages.

Mirasol, "Value Proposition Mirasol Displays—White Paper," Jun. 2009, 16 pages.

Qualcomm Inc., "Qualcomm Mirasol Displays: Technology," Feb. 7, 2014, 3 pages. Retrieved from: http://www.qualcomm.com/mirasol/technology.

Harrison et al., "Texture Displays: A Passive Approach to Tactile Presentation," Boston, MA, USA, Apr. 9, 2009, pp. 2261-2264.

Jager et al., "Microfabricating Conjugated Polymer Actuators," Science, Issues in Nanotechnology, vol. 290, Nov. 24, 2000, pp. 1540-1545. Retrieved from: http://www-mtl.mit.edu/researchgroups/mems-salon/yawen_Microfabricating_conjugated_polymer_actuators.pdf.

PCT International Search Report and Written Opinion received in PCT Application PCT/US2015/014550, dated Apr. 24, 2015, 11 pages.

* cited by examiner

TECHNIQUES FOR IMAGE ENHANCEMENT USING A TACTILE DISPLAY

BACKGROUND

Electronic displays are commonly used as an output device for visual presentation of information. Typical applications for displays include computing systems, televisions, and smartphones, to name a few. Some displays may be integrated with touchscreen technology to allow for user input. Displays sometimes incorporate an anti-reflective material to reduce glare, and thin film displays themselves are generally made as thin as possible to increase the maximum viewing angle in an effort to solve this glare issue. Other types of displays, such as electrophoretic (e-ink) displays, are designed for low-glare visibility, but they tend to lack the response time, resolution, and color density of traditional thin-film displays. Some hybrid display technologies, such as interferometric modulator displays (IMODs) that include an array of microelectromechanical systems (MEMS) devices, provide low-power solutions to dynamic light environments, but do not address glare since they have flat surfaces with an index of refraction that is governed by the presence of a flat glass display (coated or uncoated) having an index higher than that of the surrounding air. Active-texture or tactile displays are an emerging technology, with earlier versions being used to implement Braille systems.

DETAILED DESCRIPTION

Techniques are disclosed for enhancing the quality of a displayed image using a tactile or other texture display. In particular, the techniques leverage active-texture display technology to enhance the quality of graphics by providing, for example, outlining or shading (or both) when presenting a given image, so as to create the effect of increased contrast and image quality. This effect can be present even at high viewing angles and in environments of high light reflection. In accordance with some embodiments, one or more graphics processes, such as edge detection and/or shading, may be applied to an image to be displayed. In turn, the actuator elements of the tactile display (e.g., microelectromechanical systems, or MEMS, devices) may be adjusted or otherwise controlled so as to alter the displayed image. For instance, in some cases, the actuator elements associated with edges detected in the displayed image can be activated so as to provide an outlining effect in the displayed image. The actuator elements associated with certain surfaces detected in the displayed image can be activated so as to provide a shading effect in the displayed image. In this way, the texture display is effectively used to enhance one or more image attributes. Further note that the adjustments made to the texture display also may serve to reduce observable glare. In accordance with some specific embodiments, a given texture display implemented with an array of MEMS devices can be controlled to have the Z-height of one or more of the MEMS elements (e.g., with respect to the plane of the pixels and display surface) manipulated so as to enhance image quality by providing fine-grain adjustment of image attributes such as: pixel brightness/intensity; pixel color; edge highlighting; object outlining; effective shading; image contrast; and/or viewing angle. Numerous configurations and variations will be apparent in light of this disclosure.

General Overview

Figure 1A:
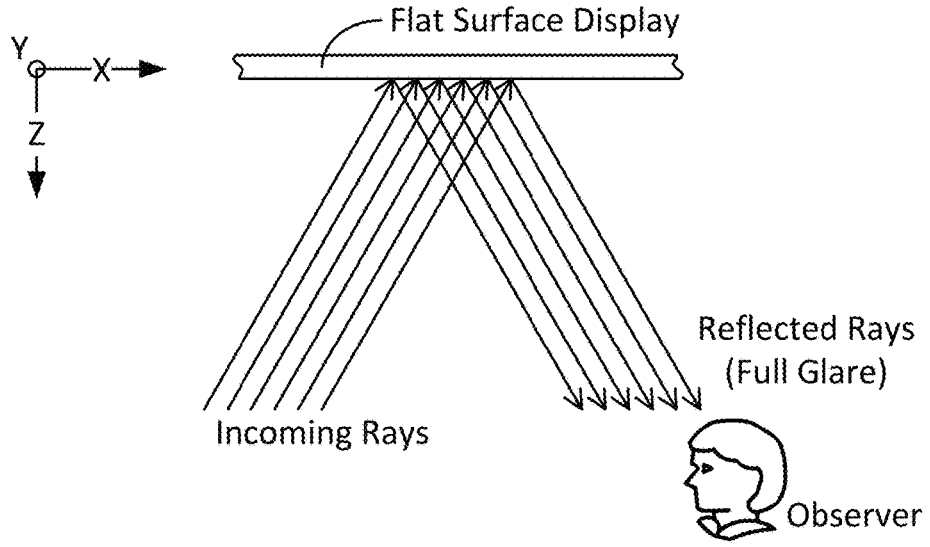
FIG. 1A depicts a typical flat surface display.
Figure 1B:
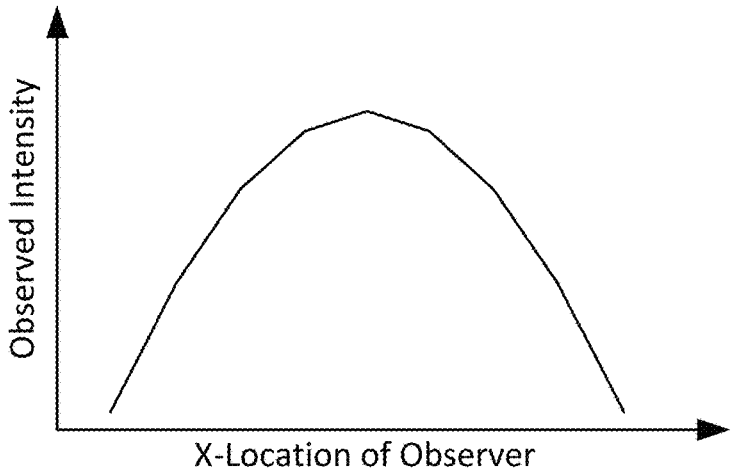
FIG. 1B is a plot generally demonstrating the relationship between observed intensity and the location of an observer (along the X-axis) relative to the flat surface display of FIG. 1A.

The visibility of an electronic visual display is typically limited by the amount of glare that its displaying surface produces and by the visual acuity of the observer. To illustrate this point, consider FIG. 1A, which depicts a typical flat surface display, and FIG. 1B, which is a plot generally demonstrating the relationship between observed intensity and the location of an observer (along the X-axis) relative to the flat surface display of FIG. 1A. As can be seen here, incoming light rays reflect off of the flat display surface and are allowed to enter an observer's eye without any reduction. The resultant glare obscures light from the displayed image and thus diminishes perceived image quality for the observer. As previously explained, a number of current display designs are configured to address glare-based issues, but all such designs are associated with shortcomings.

Thus, and in accordance with some embodiments of the present disclosure, techniques are disclosed for enhancing the quality of a displayed image using a tactile or other texture display. The techniques effectively use or otherwise exploit active-texture display technology to enhance the quality of graphics by providing fine-grain adjustment of image attributes when presenting a given image. The adjustment may create, for instance, the effect of increased contrast and image quality and may further reduce glare. This effect can be present even at high viewing angles and in environments of high light reflection. In accordance with some embodiments, one or more graphics processes, such as edge-detection and/or shading, may be applied to an image to be displayed. In turn, the microelectromechanical systems (MEMS) elements or other actuator elements of the tactile display may be adjusted so as to alter the displayed image based on the detected edge and shading information. As will be appreciated in light of this disclosure, such manipulation of the tactile display effectively enhances one or more image attributes of the displayed image, and may further reduce observable glare. In accordance with some embodiments, the Z-height of a MEMS element (e.g., with respect to the plane of the pixels and display surface) may be manipulated, for example, to provide fine-grain adjustment of image attributes such as: pixel brightness/intensity; pixel color; edge highlighting; object outlining; effective shading; image contrast; and/or viewing angle. Thus, as will be further appreciated in light of this disclosure, the adjustment of Z-height at the pixel level of a tactile display may provide an additional parameter, for example, to enhance the image quality of an image displayed thereby.

In accordance with some embodiments, a given texture display is implemented with an array of MEMS devices or other suitable actuators that can manipulate the presentation of image data at a pixel level (single pixel or a group of pixels). MEMS elements of that tactile display can be controlled as described herein to produce outlining and/or shading of objects in a displayed image, thereby creating an effect of increased contrast and/or enhanced image quality. Objects and features in the image can be detected, for example, using any number of known image processing techniques, such as edge detection, shading, segmentation, facial recognition, object recognition, and depth detection techniques. As will be appreciated in light of this disclosure, techniques disclosed herein can be utilized with any type of tactile electronic visual display, such as those that may be utilized in: a television; a computer monitor or other display; a laptop/notebook computer; a tablet computer; a mobile phone or smartphone; a personal digital assistant (PDA); and/or a media player device.

Some embodiments may enhance image quality to a degree which provides for a 4K ultra high definition (UHD) resolution or higher. Some embodiments may improve perceivable image quality, for example, beyond limits normally imposed by the visual acuity of a typical human eye. Also, in accordance with some embodiments, use of the disclosed techniques may be detected, for example, by visual and/or performance inspection (e.g., during a functional test) of a given tactile display having MEMS elements which may be controlled so as to outline and/or shade objects in a displayed image, as described herein.

Structure and Operation

Figure 2:
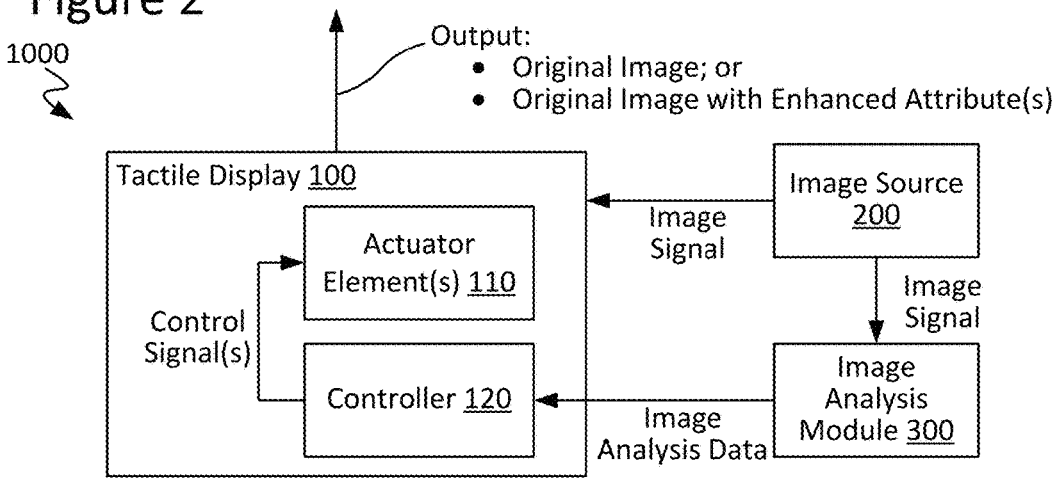
FIG. 2 is a block diagram of a system configured in accordance with an embodiment of the present disclosure.

FIG. 2 is a block diagram of a system 1000 configured in accordance with an embodiment of the present disclosure. As can be seen, system 1000 may include a tactile display 100. Tactile display 100 may be any electronic visual display, such as, for example: a television; a computer monitor or other computer display; a laptop/notebook computer display; a tablet computer display; a mobile phone or smartphone display; a personal digital assistant (PDA) display; and/or a media player device display. In a more general sense, tactile display 100 may be any display that can be hosted by or otherwise communicatively coupled with any computing device, mobile or otherwise. Tactile display 100 may be configured with or without backlighting, as desired for a given target application or end-use. Numerous configurations will be apparent in light of this disclosure.

Figure 3A:
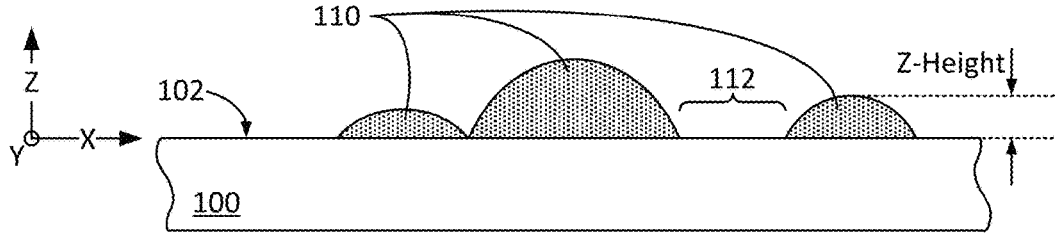
FIG. 3A is a partial cross-sectional view of a tactile display configured in accordance with an embodiment of the present disclosure.

In accordance with some embodiments, tactile display 100 may be configured to adjust/change its physical properties so as to manipulate its individual pixels (or pixel groups). More particularly, tactile display 100 may be configured, in accordance with some embodiments, to generate a texture (e.g., a pattern or other distribution of high and/or low spots) upon its display surface 102. To that end, tactile display 100 may include one or more actuator elements 110 on its display surface 102, such as is generally depicted in FIG. 3A, which is a partial cross-sectional view of a tactile display 100 configured in accordance with an embodiment of the present disclosure. A given actuator element 110 may be associated with one or more pixels of the tactile display 100, in accordance with some embodiments. It should be noted, however, that not every pixel of tactile display 100 need have an actuator element 110 associated therewith, as in some cases, display surface 102 may include one or more regions 112 devoid of an actuator element 110 altogether. The actuator elements 110 of tactile display 100 may be provided with any desired arrangement, and in some example cases may be arranged in a regular or semi-regular array (e.g., so as to correspond with a regular or semi-regular arrangement of pixels).

A given actuator element 110 may have any of a wide range of configurations. In some instances, a given actuator element 110 may be a microelectromechanical systems (MEMS) device. In some cases, a given actuator element 110 may be an electrically switched light modulator, such as an interferometric modulator element typically utilized in an interferometric modulator display (IMOD). In some instances, a given actuator element 110 may include a ceramic piezoelectric material, such as lead zirconium titanate ($Pb(Zr_xTi_{1-x})O_3$) and/or zinc oxide (ZnO). In some cases, a given actuator element 110 may include an electroactive polymer (EAP) material. In some cases, it may be desirable to fabricate a given actuator element 110 from a material (e.g., ZnO) that can be grown as a high-quality thin film on a glass substrate, thus helping to reduce cost, improve device manufacturing efficiency, facilitate integration with thin-film transistor (TFT)-based displays, and/or ensure compatibility with display manufacturing processes.

In some instances, it may be desirable to fabricate a given actuator element 110 from a material that is optically transparent at one or more optical thicknesses. In some such cases, use of an optically transparent material for actuator element 110 may help to prevent or otherwise reduce obstruction of any backlighting source, such as a light-emitting diode (LED) or other liquid crystal display (LCD) element, optically coupled with tactile display 100. In some cases, the material composition of a given actuator element 110 may be selected, for example, such that it exhibits a first optical transparency (e.g., in the range of about 90-99% optically transparent) at a first thickness, and exhibits a different second optical transparency (e.g., in the range of about 80-90%) at a second thickness. In some instances, a given actuator element 110 may be manipulated in thickness so as to become comparatively more or less optically absorbent, as desired for a given target application or end-use. In accordance with some embodiments, the selection of a given material for a given actuator element 110 may be made, at least in part, based on the absorption spectra associated with such material. Other suitable types of actuator elements 110 for use in a tactile display 100 will depend on a given application and will be apparent in light of this disclosure.

In accordance with some embodiments, a given actuator element 110 may be bimodal. For instance, consider FIG. 3B, which generally illustrates an actuator element 110 having example actuated and unactuated states, in accordance with an embodiment of the present disclosure. As can be seen here, a given actuator element 110 may have: (1) an unactuated state (e.g., a ground state or low state) in which it remains substantially flush with the display surface 102 of tactile display 100 and thus has a Z-height equal to or about equal to zero (e.g., within a given tolerance of zero); and (2) an actuated state (e.g., a high state) in which it extends (e.g., maximally extends) away from the display surface 102 of tactile display 100 to a Z-height that is greater than zero. In accordance with some other embodiments, a given actuator element 110 may have: (1) an unactuated state (e.g., a high state) in which it is extended (e.g., maximally extended) away from the display surface 102 of tactile display 100 at a Z-height that is greater than zero; and (2) an actuated state in which it is collapsed or otherwise reduced in Z-height such that it is substantially flush with the display surface 102 of tactile display 100 and thus has a Z-height equal to or about equal to zero (e.g., within a given tolerance of zero).

In accordance with some embodiments, a given actuator element 110 may be multimodal, having an unactuated state and one or more actuated states. For instance, consider FIG. 3C, which generally illustrates an actuator element 110 having example positively actuated, unactuated, and negatively actuated states, in accordance with an embodiment of the present disclosure. As can be seen here, a given actuator element 110 may have an intermediate state (e.g., between its lowest state and highest state), in which the actuator element 110 extends away from the display surface 102 of tactile display 100 to a Z-height greater than zero and/or greater than its minimum capable Z-height, but less than its maximum capable Z-height. In some instances, such an intermediate state may be designated the unactuated state (e.g., ground state) of the actuator element 110. In accordance with some embodiments, an actuator element 110 having a reduced Z-height as compared to its ground state may be considered to be in a negatively actuated state (e.g., compressed; reduced in Z-height). Conversely, an actuator element 110 having an increased Z-height as compared to its ground state may be considered to be in a positively actuated state (e.g., extended; increased in Z-height), in accordance with some embodiments. As will be appreciated in light of this disclosure, any quantity of intermediate positively and/or negatively actuated states may be provided for a given actuator element 110, as desired for a given target application or end-use.

Figure 3B:
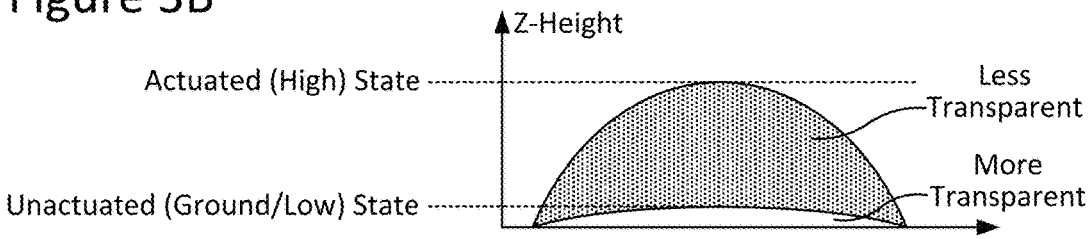
FIG. 3B generally illustrates an actuator element having example actuated and unactuated states, in accordance with an embodiment of the present disclosure.
Figure 3C:
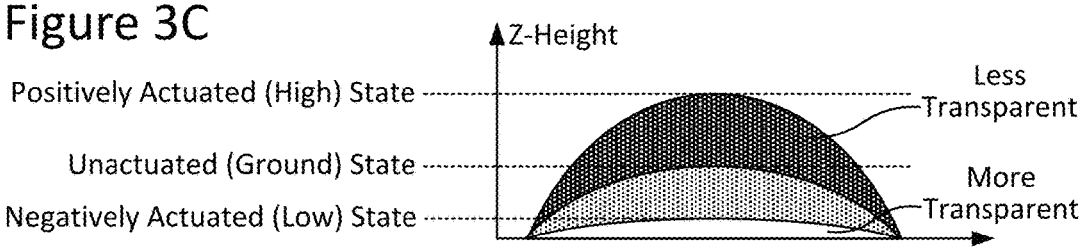
FIG. 3C generally illustrates an actuator element having example positively actuated, unactuated, and negatively actuated states, in accordance with an embodiment of the present disclosure.

In some instances, the ground/low state of a given actuator element 110 may be comparatively more optically transmissive (e.g., less optically absorbent) than its high state, as generally illustrated in FIG. 3B. In some other instances, the low state of a given actuator element 110 may be comparatively more optically transmissive (e.g., less optically absorbent) than its ground state and/or its high state, as generally illustrated in FIG. 3C. Numerous configurations will be apparent in light of this disclosure.

It should be noted, however, that the actuator elements 110 of tactile display 100 are not so limited only to actuated states involving dimensional extension along the Z-axis. For example, in some embodiments, changes in surface area, geometry, tilt angle, and/or any other modifiable characteristic of a given actuator element 110 may be provided, as desired. In some instances, a given actuator element 110 may be configured for adjustment of its characteristics in only one dimension (e.g., Z-height only), while in some other instances, adjustment in two or more dimensions (e.g., Z-height and its dimensions along the X-axis and/or Y-axis) may be provided. Numerous suitable configurations will be apparent in light of this disclosure.

The optical depth of a given actuator element 110 may depend, at least in part, on its thickness (e.g., its Z-height), the optical absorption characteristics of its one or more constituent materials, and/or the wavelength(s) of light incident therewith. Thus, and in accordance with some embodiments, a given actuator element 110 may be configured such that, with positive and/or negative actuation, its Z-height can be adjusted from a first thickness at which it exhibits a first optical transparency to a second thickness at which it exhibits a second, different optical transparency. More generally, the Z-height of a given actuator element 110 can be manipulated, in accordance with some embodiments, to adjust its optical transparency and thus change its optical absorption of a given wavelength of light, which in turn may decrease light transmission from display surface 102, thereby reducing observable glare. Also, in accordance with some embodiments, the material composition of a given actuator element 110 may be selected, at least in part, so as to customize its optical absorption characteristics, as desired for a given target application or end-use. In some instances, a first actuator element 110 may be positively and/or negatively actuated to adjust (e.g., decrease and/or increase) its optical absorbance relative to one or more other actuator elements 110. Adjustments to the thickness and/or material composition of a given actuator element 110 may be performed, in accordance with some embodiments, to: (1) enhance the pixel brightness/intensity, edge highlighting, object outlining, effective shading, image contrast, and/or viewing angle of an image displayed by tactile display 100; and/or (2) reduce observable glare.

As previously discussed, a given actuator element 110 may be actuated to adjust one or more of its characteristics (e.g., its thickness/Z-height), in accordance with some embodiments. To that end, a given actuator element 110 of tactile display 100 may be operatively coupled with a controller 120 configured, in accordance with some embodiments, to output a control signal to actuate the actuator element 110, causing it to change in one or more characteristics. In some cases, all (or some sub-set) of the actuator elements 110 of tactile display 100 may be coupled with a single shared controller 120, which in turn may be configured to provide a given number of control signals, as desired for a given target application or end-use. In some other cases, each actuator element 110 of tactile display 100 may be coupled with its own separate controller 120. Any degree of functional distributedness of controller 120 may be provided, as desired for a given target application or end-use.

As can be seen further from FIG. 2, system 1000 also may include an image source 200. In accordance with some embodiments, image source 200 may be any device, mobile or otherwise, which is configured to output an image signal. For instance, image source 200 may be (or otherwise include): a desktop computer; a laptop/notebook computer; a tablet computer; a mobile phone or smartphone; a digital versatile disc (DVD) player; a Blu-Ray disc player; a set-top box (STB); a gaming platform or handheld gaming device; a personal digital assistant (PDA); and/or a media player device. In accordance with some embodiments, image source 200 may be (or otherwise include) memory/storage, a central processing unit (CPU), an accelerated processing unit (APU), and/or a graphics processing unit (GPU) of a computing device, for example. Other suitable image sources 200 will depend on a given application and will be apparent in light of this disclosure.

In accordance with some embodiments, image source 200 may be configured to output an image signal (e.g., including original image data of an image to be displayed by tactile display 100) to: (1) tactile display 100; and/or (2) image analysis module 300 (discussed below). To these ends, image source 200 may be configured for wired (e.g., Universal Serial Bus or USB; Ethernet; FireWire; etc.) and/or wireless (e.g., Wi-Fi; Bluetooth; etc.) communication, in accordance with some embodiments.

Also, as can be seen from FIG. 2, system 1000 may include an image analysis module 300. In some embodiments, image analysis module 300 may be a separate device, distinct from image source 200 and/or tactile display 100. In some other embodiments, image analysis module 300 may be hosted, in part or in whole, by image source 200 and/or tactile display 100. Image analysis module 300 may be configured for wired and/or wireless communication with image source 200 and/or tactile display 100 using any of the example techniques discussed above with reference to image source 200. Numerous configurations will be apparent in light of this disclosure.

In accordance with some embodiments, image analysis module 300 may be configured to analyze an image signal provided by an upstream image source 200 and output image analysis data to the one or more controllers 120 of tactile display 100. To that end, image analysis module 300 may include custom, proprietary, known, and/or after-developed image/video processing code or instruction sets that are generally well-defined and operable to analyze an image to output image analysis data pertaining to contents of the image to be displayed. For instance, image analysis module 300 may include one or more graphics analysis processes, such as edge-detection (e.g., as discussed with reference to FIG. 6) and/or shading (e.g., as discussed with reference to FIG. 8). Image analysis module 300 may be configured to apply a single graphics process or multiple graphics processes (e.g., simultaneously; in succession), as desired for a given target application or end-use. In accordance with some embodiments, image analysis module 300 may output image analysis data to the one or more controllers 120 of tactile display 100, for example, for purposes of causing adjustment of one or more actuator elements 110 of tactile display 100. Other suitable capabilities and configurations for image analysis module 300 will depend on a given application and will be apparent in light of this disclosure.

Figure 4A:
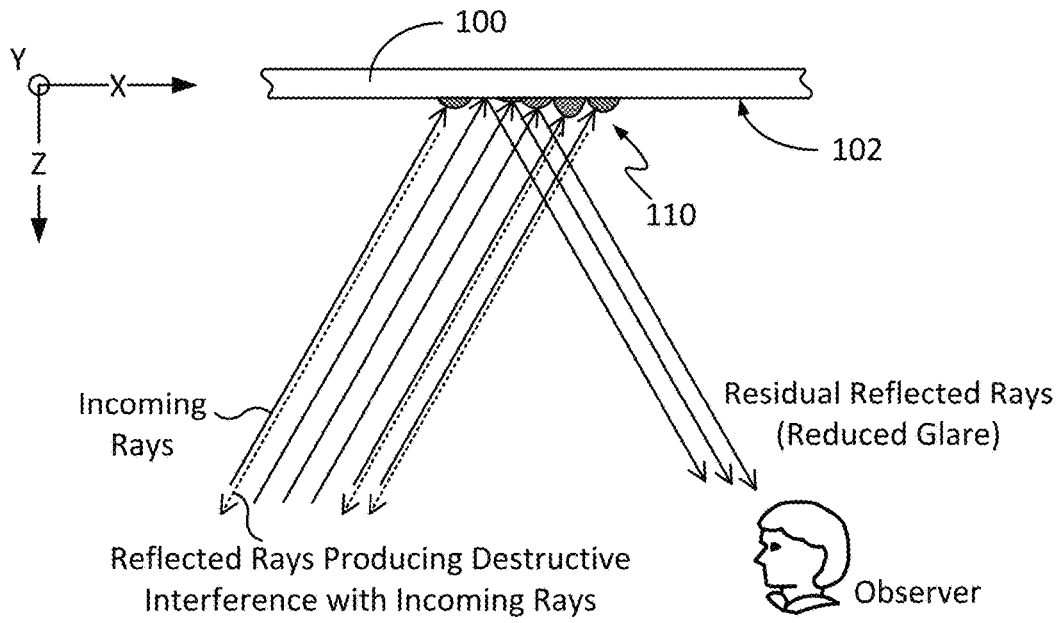
FIG. 4A generally illustrates how a tactile display including a textured display surface may provide for glare reduction, in accordance with an example embodiment of the present disclosure.
Figure 4B:
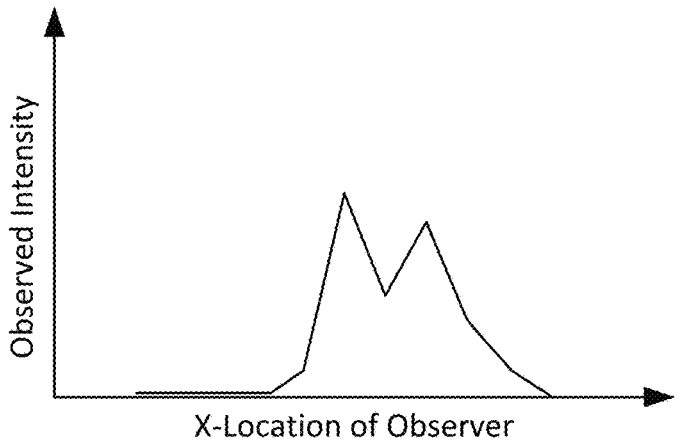
FIG. 4B is a plot generally demonstrating the relationship between observed intensity and the location of an observer (along the X-axis) relative to the tactile display of FIG. 4A.

In accordance with some embodiments, tactile display 100 may be configured such that its actuator elements 110 may be adjusted, for instance, in Z-height to eliminate or otherwise reduce glare from display surface 102. FIG. 4A generally illustrates how a tactile display 100 including a textured display surface 102 may provide for glare reduction by destructive interference, in accordance with an example embodiment of the present disclosure. Unlike the flat display discussed above with reference to FIG. 1A, here, tactile display 100 includes a region of mixed-height display surface 102 that serves, at least in part, to scatter incident light, resulting in at least some destructive interference with the incoming light rays. Consequently, this may decrease the intensity of the light that is reflected from display surface 102 and allowed to enter an observer's eye, thus reducing or eliminating the glare experienced by the observer, as generally demonstrated by the plot of FIG. 4B.

Figure 5A:
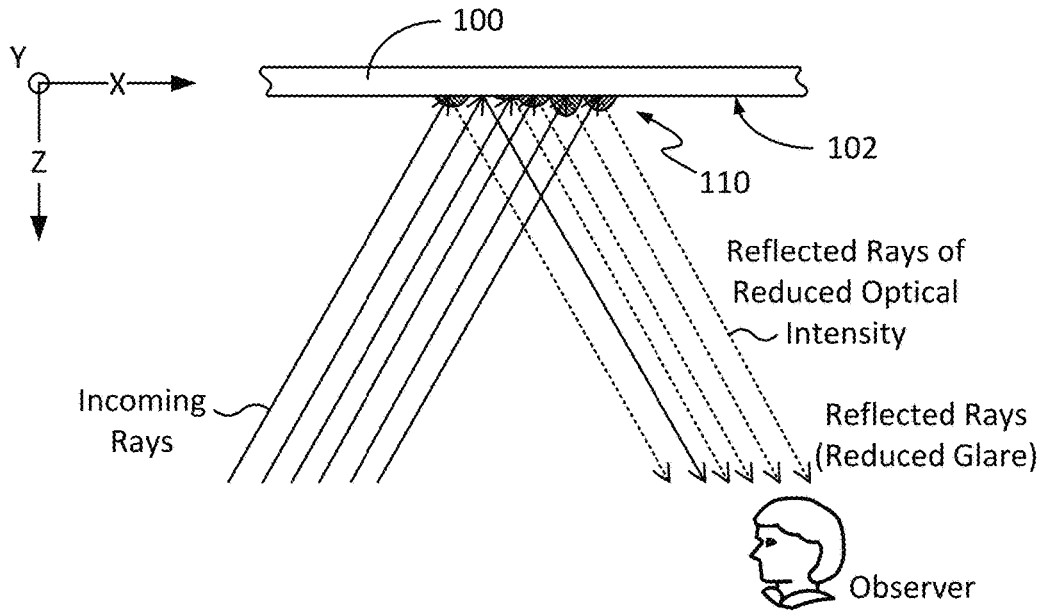
FIG. 5A generally illustrates how a tactile display including a textured display surface may provide for glare reduction, in accordance with another example embodiment of the present disclosure.
Figure 5B:
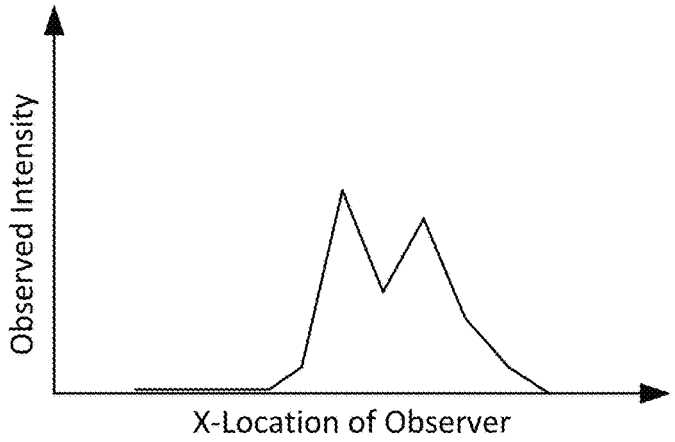
FIG. 5B is a plot generally demonstrating the relationship between observed intensity and the location of an observer (along the X-axis) relative to the tactile display of FIG. 5A.

The present disclosure is not so limited, however. For instance, consider FIG. 5A, which generally illustrates how a tactile display 100 including a textured display surface 102 may provide for glare reduction by optical absorption, in accordance with an example embodiment of the present disclosure. Unlike the flat display discussed above with reference to FIG. 1A, here, tactile display 100 includes a region of mixed-height display surface 102 that serves, at least in part, to absorb incident light, resulting in at least some reduction in optical intensity of the reflected light rays. Consequently, this may decrease the intensity of the light that is reflected from display surface 102 and allowed to enter an observer's eye, thus reducing or eliminating the glare experienced by the observer, as generally demonstrated by the plot of FIG. 5B.

Methodologies

Figure 6:
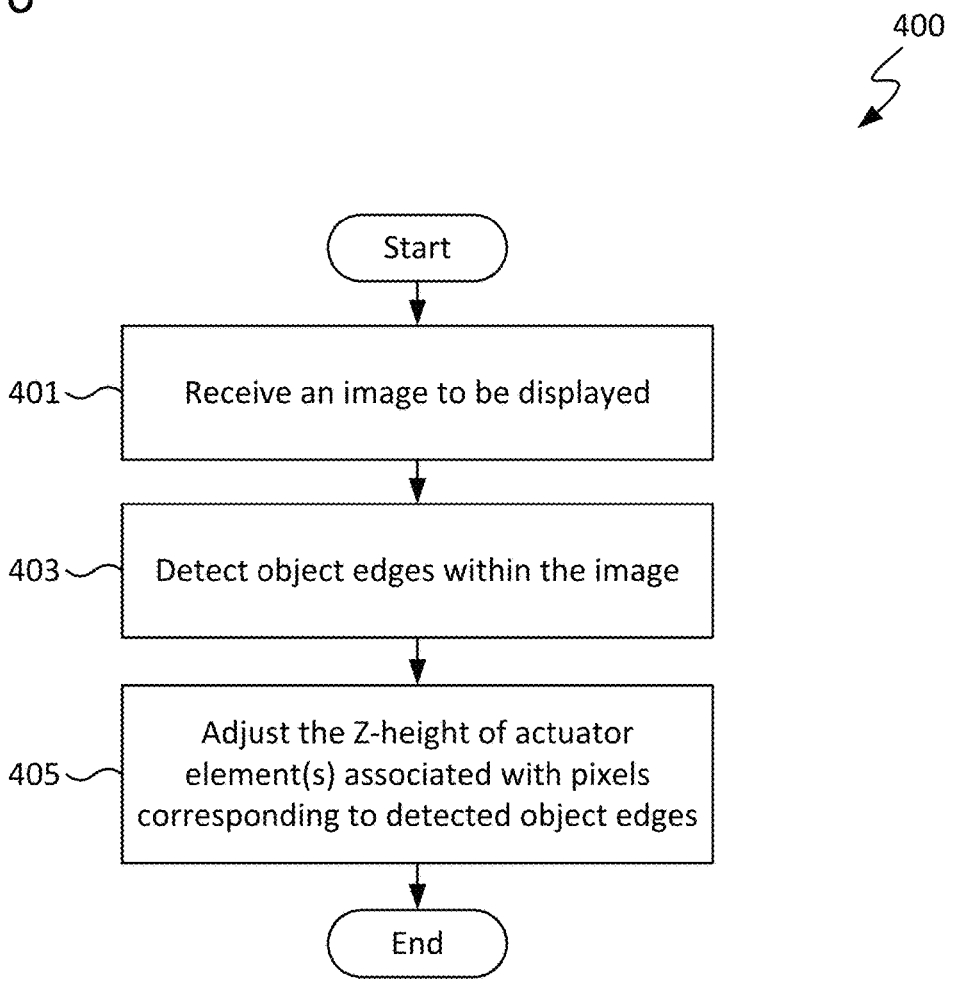
FIG. 6 is a flow diagram illustrating a method of using a tactile display to display an image, in accordance with an embodiment of the present disclosure.
Figure 7A:
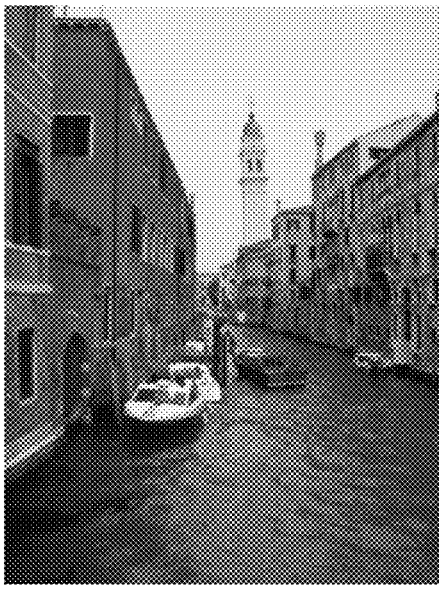
FIG. 7A depicts an example original image to be displayed by a tactile display, in accordance with an embodiment of the present disclosure.

FIG. 6 is a flow diagram illustrating a method 400 of using a tactile display 100 to display an image, in accordance with an embodiment of the present disclosure. As can be seen, the method 400 may begin as in block 401 with receiving an image to be displayed. In accordance with some embodiments, the image to be displayed may be provided, for example, by an image source 200 communicatively coupled with the tactile display 100 and may include any image, video, text, and/or other displayable content, as will be apparent in light of this disclosure. FIG. 7A depicts an example original image to be displayed by a tactile display 100, in accordance with an example embodiment.

Figure 7B:
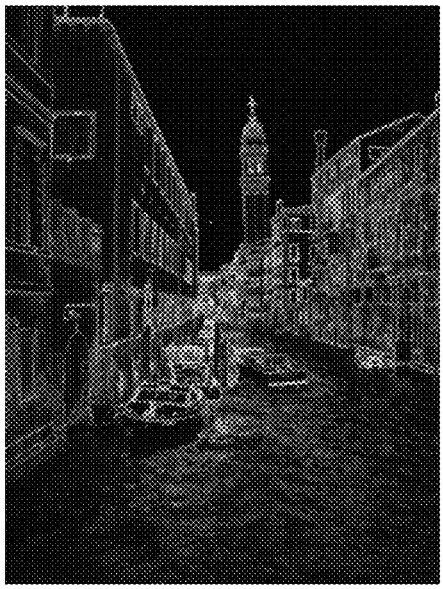
FIG. 7B depicts the image of FIG. 7A having undergone edge-detection, in accordance with an example embodiment of the present disclosure.

The method 400 may proceed as in block 403 with detecting object edges within the image to be displayed. To that end, any suitable custom, proprietary, known, and/or after-developed edge-detection process may be applied to the image to be displayed. In accordance with some embodiments, the edge-detection process may be applied by an image analysis module 300, as previously discussed. In accordance with some embodiments, the applied edge-detection process may locate boundaries between light and dark regions, for instance, by finding sufficiently large gradients in brightness. FIG. 7B depicts the image of FIG. 7A having undergone edge-detection, in accordance with an example embodiment.

Figure 7C:
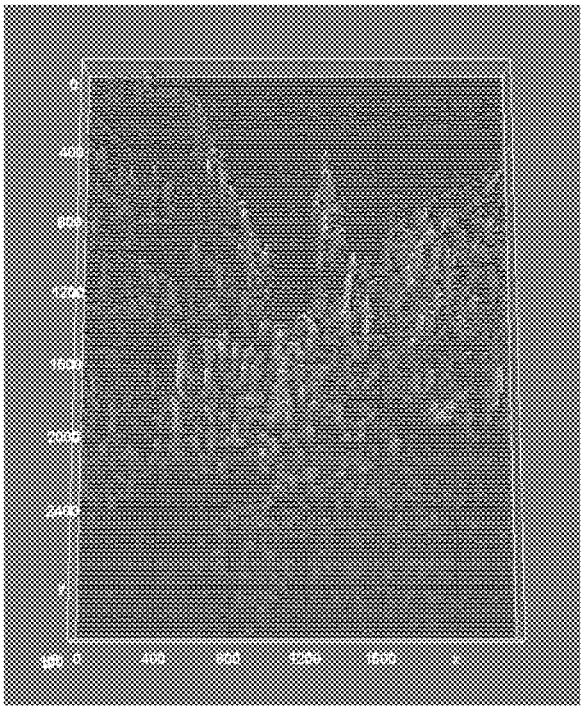
FIG. 7C represents an example image analysis data set resulting from analysis of the image of FIG. 7B, in accordance with an example embodiment of the present disclosure.

After application of an edge-detection process, the resultant image analysis data (or other graphics information) may be transmitted by image analysis module 300, for example, to a controller 120 (previously discussed). As discussed below, this image data may be utilized to indicate where to generate texture along display surface 102 to outline graphics and/or enhance image contrast, in accordance with some embodiments. FIG. 7C represents an example image analysis data set resulting from analysis of the image of FIG. 7B, in accordance with an example embodiment.

The method 400 may continue as in block 405 with adjusting the Z-height of one or more actuator elements 110 associated with pixels corresponding to object edges detected in the image to be displayed. In accordance with some embodiments, a controller 120 may receive input from image analysis module 300 and in turn output one or more control signals to cause a given actuator element 110 of tactile display 100 to change one or more of its characteristics. For instance, in accordance with some embodiments, the actuator element(s) 110 of tactile display 100 that are associated with pixels corresponding to edges of objects contained within the image to be displayed by tactile display 100 may be manipulated in Z-height so as to raise the display surface 102 along edges of objects within the image to be displayed and thus highlight those object edges.

In accordance with some embodiments, application of the method 400 of FIG. 6 may provide for outlining of graphics within an image and/or enhancement of image contrast at high viewing angles and/or in high glare situations. In some instances, the high viewing angle provided by manipulating the Z-height of the display surface 102 may effectively change the surface area of the tactile display 100 for each pixel. Thus, in a general sense, the Z-height of the display surface 102 of a tactile display 100 may provide an additional parameter for adjusting an individual pixel's effective brightness, in accordance with some embodiments.

Figure 8:
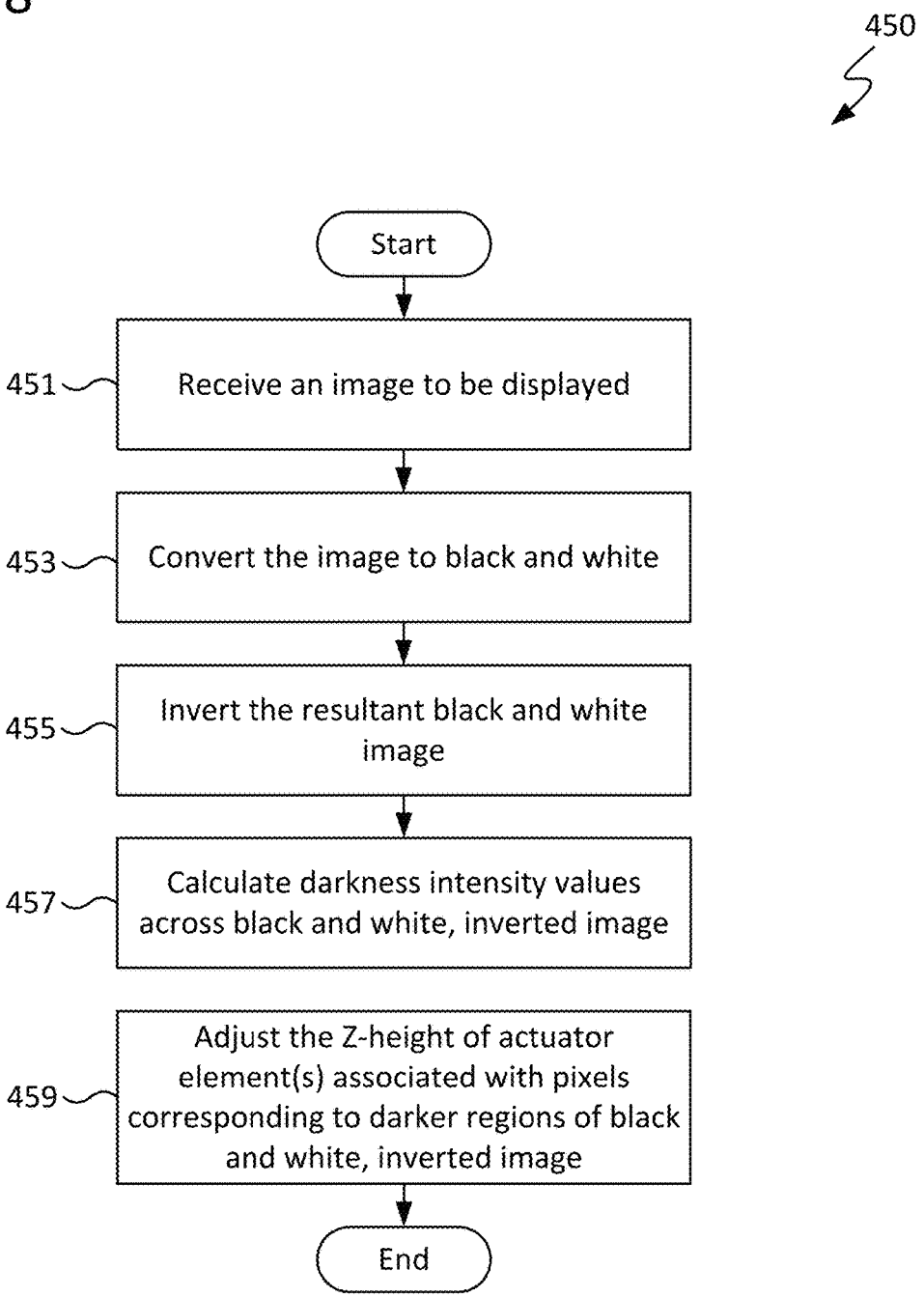
FIG. 8 is a flow diagram illustrating a method of using a tactile display to display an image, in accordance with another embodiment of the present disclosure.
Figure 9A:
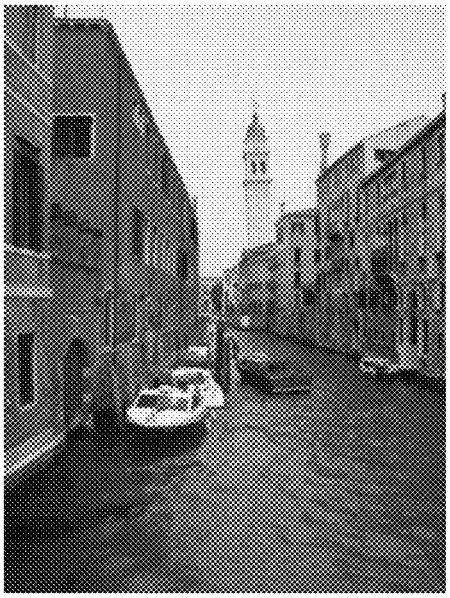
FIG. 9A depicts an example original image to be displayed by a tactile display, in accordance with an embodiment of the present disclosure.

FIG. 8 is a flow diagram illustrating a method 450 of using a tactile display 100 to display an image, in accordance with another embodiment of the present disclosure. As can be seen, the method 450 may begin as in block 451 with receiving an image to be displayed. The image to be displayed may be provided by any of the example image sources 200 discussed above and may include any image, video, text, and/or other displayable content, as will be apparent in light of this disclosure. FIG. 9A depicts an example original image to be displayed by a tactile display 100, in accordance with an embodiment.

Figure 9B:
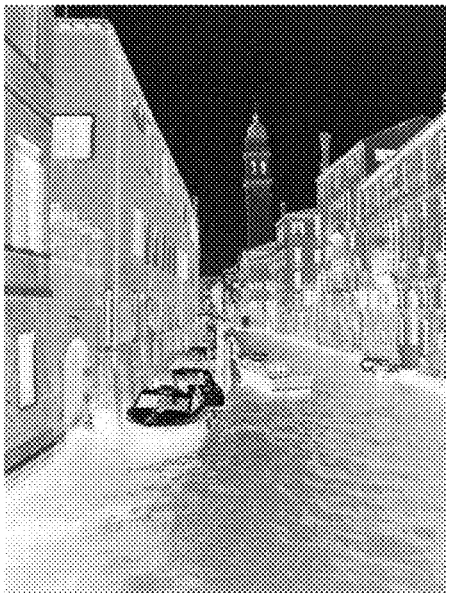
FIG. 9B depicts the image of FIG. 9A having undergone conversion to a black and white image and subsequent inversion, in accordance with an example embodiment of the present disclosure.

The method 450 may proceed as in blocks 453 and 455 with converting the image to be displayed to a black and white image and subsequently inverting the resultant black and white image. To these ends, any suitable custom, proprietary, known, and/or after-developed graphics processes may be applied to the image to be displayed. In accordance with some embodiments, these graphics processes may be applied by an image analysis module 300, as previously discussed. FIG. 9B depicts the image of FIG. 9A having undergone conversion to a black and white image and subsequent inversion, in accordance with an example embodiment.

The method 450 may continue as in block 457 with calculating darkness intensity values across the resultant black and white, inverted image. To that end, any suitable custom, proprietary, known, and/or after-developed brightness detection process may be applied. In accordance with some embodiments, the brightness detection process may be applied by an image analysis module 300, as previously discussed. In accordance with some embodiments, the applied brightness detection process may detect regions of blackness (e.g., the lack of light) across the resultant image and calculate intensity values therefor.

Figure 9C:
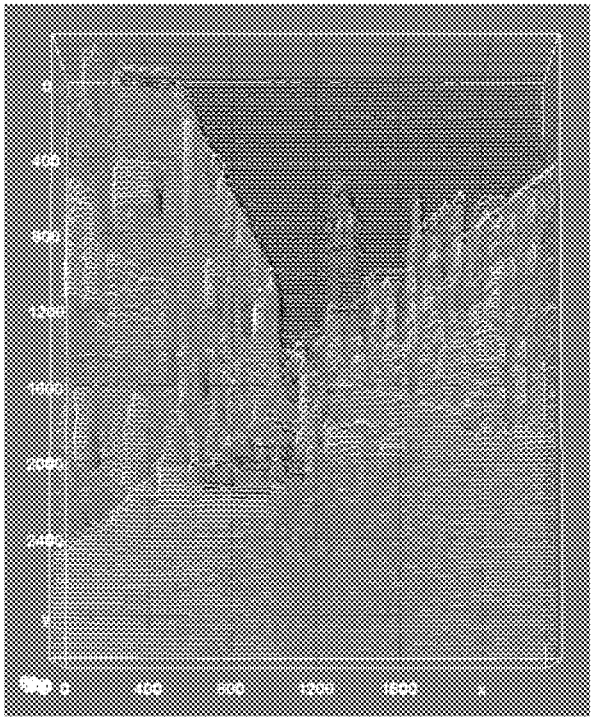
FIG. 9C represents an example image analysis data set resulting from analysis of the black and white, inverted image of FIG. 9B, in accordance with an example embodiment of the present disclosure.

After application of a brightness detection process, the resultant image analysis data (or other graphics information) may be transmitted by image analysis module 300, for example, to a controller 120 (previously discussed). As discussed below, this image data may be utilized in designating an area of display surface 102 along which to generate texture to produce a shading effect and/or enhance image contrast, in accordance with some embodiments. FIG. 9C represents an example image analysis data set resulting from analysis of the black and white, inverted image of FIG. 9B, in accordance with an example embodiment.

The method 450 may continue as in block 459 with adjusting the Z-height of one or more actuator elements 110 associated with pixels corresponding to darker regions of the black and white, inverted image. In accordance with some embodiments, a controller 120 may receive input from image analysis module 300 and in turn output one or more control signals to cause a given actuator element 110 of tactile display 100 to change one or more of its characteristics. For instance, in accordance with some embodiments, the actuator element(s) 110 of tactile display 100 that are associated with pixels corresponding to darker regions of the black and white, inverted image may be manipulated in Z-height so as to raise the display surface 102 within those darker regions and thus generate a graded display surface 102 that provides localized shaded regions within the image to be displayed (e.g., the original image that has not been converted to black and white or subsequently inverted).

In accordance with some embodiments, application of the method 450 of FIG. 8 may provide for enhanced effective shading intensity and/or enhancement of image contrast at 0° and/or high angle viewing. In accordance with some embodiments, the enhanced effective shading intensity may provide an additional parameter for adjusting an individual pixel's intensity and/or color.

Numerous variations on the methods 400 and 450 and one or more associated graphics analysis and/or processing techniques will be apparent in light of this disclosure. For example, in accordance with some other embodiments, methods 400 and/or 450 optionally may include manipulation of the Z-height of a given actuator element 110 to change the optical transparency/absorbency of such element 110, as described herein. Also, as will be appreciated, and in accordance with some embodiments, each of the functional boxes shown in FIG. 6 (e.g., 401, 403, and 405) and shown in FIG. 8 (e.g., 451, 453, 455, and 457) can be implemented, for example, as a module or sub-module that, when executed by one or more processors or otherwise operated, causes the associated functionality as described herein to be carried out. The modules/sub-modules may be implemented, for instance, in software (e.g., executable instructions stored on one or more computer readable media), firmware (e.g., embedded routines of a microcontroller or other device which may have I/O capacity for soliciting input from a user and providing responses to user requests), and/or hardware (e.g., gate level logic, field programmable gate array, purpose-built silicon, etc.).

Example System

Figure 10:
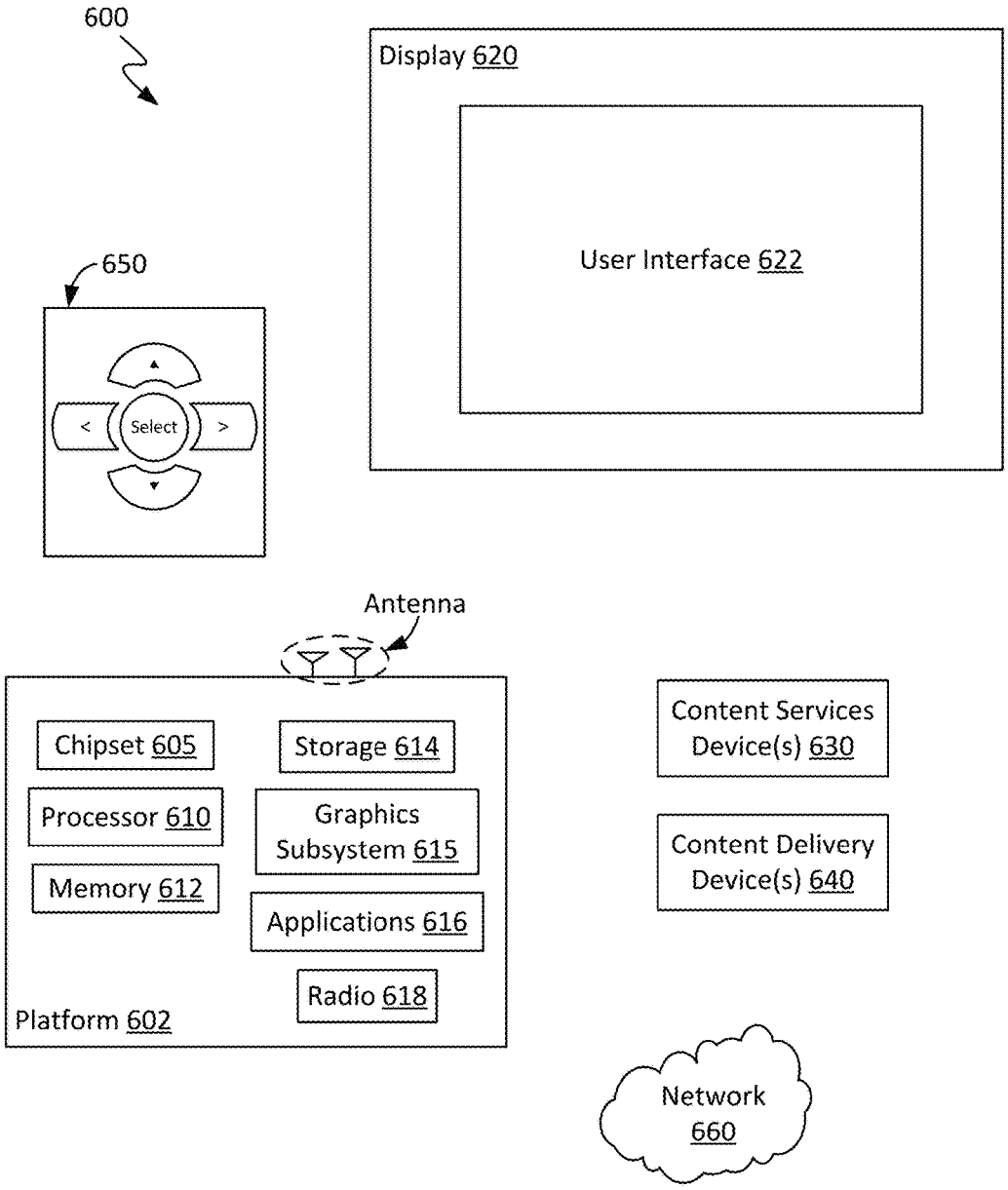
FIG. 10 illustrates an example system that may carry out the techniques for enhancing the quality of a displayed image using a tactile or other texture display as described herein, in accordance with some embodiments.

FIG. 10 illustrates an example system 600 that may carry out the techniques for enhancing the quality of a displayed image using a tactile or other texture display as described herein, in accordance with some embodiments. In some embodiments, system 600 may be a media system, although system 600 is not limited to this context. For example, system 600 may be incorporated into a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, set-top box, game console, or other such computing environments capable of performing graphics rendering operations.

In some embodiments, system 600 comprises a platform 602 coupled to a display 620 (e.g., which may be configured as a tactile display 100, as described herein). Platform 602 may receive content from a content device such as content services device(s) 630 or content delivery device(s) 640 or other similar content sources. A navigation controller 650 comprising one or more navigation features may be used to interact, for example, with platform 602 and/or display 620. Each of these example components is described in more detail below.

In some embodiments, platform 602 may comprise any combination of a chipset 605, processor 610, memory 612, storage 614, graphics subsystem 615, applications 616, and/or radio 618. Chipset 605 may provide intercommunication among processor 610, memory 612, storage 614, graphics subsystem 615, applications 616, and/or radio 618. For example, chipset 605 may include a storage adapter (not depicted) capable of providing intercommunication with storage 614.

Processor 610 may be implemented, for example, as Complex Instruction Set Computer (CISC) or Reduced Instruction Set Computer (RISC) processors, x86 instruction set compatible processors, multi-core, or any other microprocessor or central processing unit (CPU). In some embodiments, processor 610 may comprise dual-core processor(s), dual-core mobile processor(s), and so forth. Memory 612 may be implemented, for instance, as a volatile memory device such as, but not limited to, a Random Access Memory (RAM), Dynamic Random Access Memory (DRAM), or Static RAM (SRAM). Storage 614 may be implemented, for example, as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In some embodiments, storage 614 may comprise technology to increase the storage performance enhanced protection for valuable digital media when multiple hard drives are included, for example.

Graphics subsystem 615 may perform processing of images such as still or video for display. Graphics subsystem 615 may be a graphics processing unit (GPU) or a visual processing unit (VPU), for example. An analog or digital interface may be used to communicatively couple graphics subsystem 615 and display 620. For example, the interface may be any of a High-Definition Multimedia Interface (HDMI), DisplayPort, wireless HDMI, and/or wireless HD compliant techniques. Graphics subsystem 615 could be integrated into processor 610 or chipset 605. Graphics subsystem 615 could be a stand-alone card communicatively coupled to chipset 605. The techniques for enhancing the quality of a displayed image using a tactile or other texture display described herein may be implemented in various hardware architectures. For example, the techniques for enhancing the quality of a displayed image using a tactile or other texture display as provided herein may be integrated within a graphics and/or video chipset. Alternatively, a discrete security processor may be used. In still another embodiment, the graphics and/or video functions including the techniques for enhancing the quality of a displayed image using a tactile or other texture display may be implemented by a general purpose processor, including a multi-core processor.

Radio 618 may include one or more radios capable of transmitting and receiving signals using various suitable wireless communications techniques. Such techniques may involve communications across one or more wireless networks. Exemplary wireless networks may include, but are not limited to, wireless local area networks (WLANs), wireless personal area networks (WPANs), wireless metropolitan area network (WMANs), cellular networks, and satellite networks. In communicating across such networks, radio 618 may operate in accordance with one or more applicable standards in any version.

In some embodiments, display 620 may comprise any television or computer-type monitor or display. Display 620 may comprise, for example, a liquid crystal display (LCD) screen, electrophoretic display (EPD) or liquid paper display, flat panel display, touchscreen display, television-like device, and/or a television. Display 620 may be digital and/or analog. In some embodiments, display 620 may be a holographic or three-dimensional (3-D) display. Also, display 620 may be a transparent surface that may receive a visual projection. Such projections may convey various forms of information, images, and/or objects. For example, such projections may be a visual overlay for a mobile augmented reality (MAR) application. Under the control of one or more software applications 616, platform 602 may display a user interface 622 on display 620.

In some embodiments, content services device(s) 630 may be hosted by any national, international, and/or independent service and thus may be accessible to platform 602 via the Internet or other network, for example. Content services device(s) 630 may be coupled to platform 602 and/or to display 620. Platform 602 and/or content services device(s) 630 may be coupled to a network 660 to communicate (e.g., send and/or receive) media information to and from network 660. Content delivery device(s) 640 also may be coupled to platform 602 and/or to display 620. In some embodiments, content services device(s) 630 may comprise a cable television box, personal computer (PC), network, telephone, Internet-enabled devices or appliance capable of delivering digital information and/or content, and any other similar device capable of unidirectionally or bi-directionally communicating content between content providers and platform 602 and/or display 620, via network 660 or directly. It will be appreciated that the content may be communicated unidirectionally and/or bi-directionally to and from any one of the components in system 600 and a content provider via network 660. Examples of content may include any media information including, for example, video, music, graphics, text, medical and gaming content, and so forth.

Content services device(s) 630 receives content such as cable television programming including media information, digital information, and/or other content. Examples of content providers may include any cable or satellite television or radio or Internet content providers. The provided examples are not meant to limit the present disclosure. In some embodiments, platform 602 may receive control signals from navigation controller 650 having one or more navigation features. The navigation features of controller 650 may be used to interact with user interface 622, for example. In some embodiments, navigation controller 650 may be a pointing device that may be a computer hardware component (specifically human interface device) that allows a user to input spatial (e.g., continuous and multi-dimensional) data into a computer. Many systems such as graphical user interfaces (GUI) and televisions and monitors allow the user to control and provide data to the computer or television using physical gestures.

Movements of the navigation features of controller 650 may be echoed on a display (e.g., display 620) by movements of a pointer, cursor, focus ring, or other visual indicators displayed on the display. For example, under the control of software applications 716, the navigation features located on navigation controller 650 may be mapped to virtual navigation features displayed on user interface 622, for example. In some embodiments, controller 650 may not be a separate component but integrated into platform 602 and/or display 620. Embodiments, however, are not limited to the elements or in the context shown or described herein, as will be appreciated.

In some embodiments, drivers (not shown) may comprise technology to enable users to instantly turn on and off platform 602 like a television with the touch of a button after initial boot-up, when enabled, for example. Program logic may allow platform 602 to stream content to media adaptors or other content services device(s) 630 or content delivery device(s) 640 when the platform is turned "off." In addition, chip set 605 may comprise hardware and/or software support for 5.1 surround sound audio and/or high definition 7.1 surround sound audio, for example. Drivers may include a graphics driver for integrated graphics platforms. In some embodiments, the graphics driver may comprise a peripheral component interconnect (PCI) express graphics card.

In various embodiments, any one or more of the components shown in system 600 may be integrated. For example, platform 602 and content services device(s) 630 may be integrated, or platform 602 and content delivery device(s) 640 may be integrated, or platform 602, content services device(s) 630, and content delivery device(s) 640 may be integrated, for example. In various embodiments, platform 602 and display 620 may be an integrated unit. Display 620 and content service device(s) 630 may be integrated, or display 620 and content delivery device(s) 640 may be integrated, for example. These examples are not meant to limit the present disclosure.

In various embodiments, system 600 may be implemented as a wireless system, a wired system, or a combination of both. When implemented as a wireless system, system 600 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the radio frequency (RF) spectrum and so forth. When implemented as a wired system, system 600 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

Platform 602 may establish one or more logical or physical channels to communicate information. The information may include media information and control information. Media information may refer to any data representing content meant for a user. Examples of content may include, for example, data from a voice conversation, videoconference, streaming video, email or text messages, voice mail message, alphanumeric symbols, graphics, image, video, text and so forth. Control information may refer to any data representing commands, instructions, or control words meant for an automated system. For example, control information may be used to route media information through a system or instruct a node to process the media information in a predetermined manner (e.g., using the techniques for enhancing the quality of a displayed image using a tactile or other texture display, as described herein). The embodiments, however, are not limited to the elements or context shown or described in FIG. 10.

Figure 11:
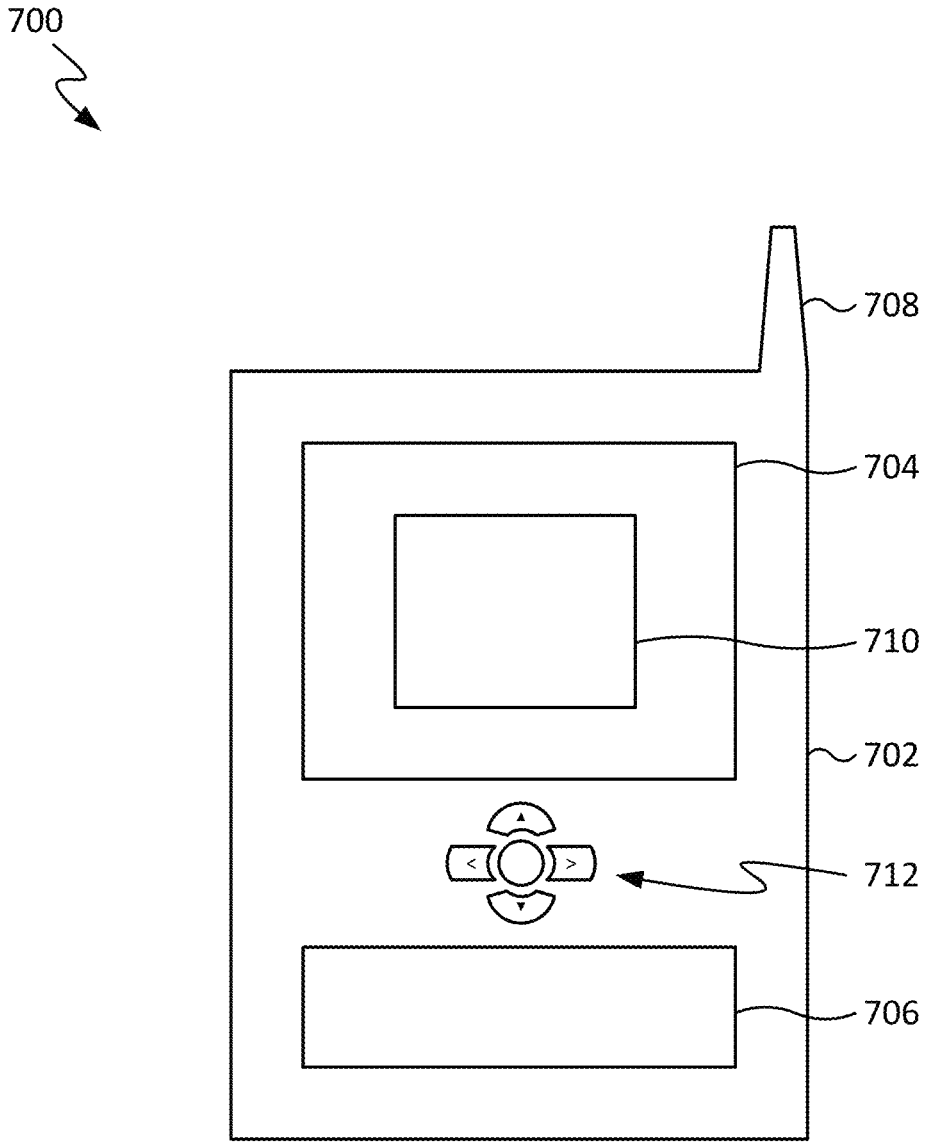
FIG. 11 illustrates embodiments of a small form factor device in which the system of FIG. 10 may be embodied.

As described above, system 600 may be embodied in varying physical styles or form factors. FIG. 11 illustrates embodiments of a small form factor device 700 in which system 600 may be embodied. In some embodiments, for example, device 700 may be implemented as a mobile computing device having wireless capabilities. A mobile computing device may refer to any device having a processing system and a mobile power source or supply, such as one or more batteries, for example.

As previously described, examples of a mobile computing device may include a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

Examples of a mobile computing device also may include computers that are arranged to be worn by a person, such as a wrist computer, finger computer, ring computer, eyeglass computer, belt-clip computer, arm-band computer, shoe computers, clothing computers, and other wearable computers. In some embodiments, for example, a mobile computing device may be implemented as a smart phone capable of executing computer applications, as well as voice communications and/or data communications. Although some embodiments may be described with a mobile computing device implemented as a smart phone by way of example, it may be appreciated that other embodiments may be implemented using other wireless mobile computing devices as well. The embodiments are not limited in this context.

As shown in FIG. 11, device 700 may comprise a housing 702, a display 704 (e.g., a display, such as display 620 and/or display 100, discussed herein), an input/output (I/O) device 706, and an antenna 708. Device 700 may include a user interface (UI) 710. Device 700 also may comprise navigation features 712. Display 704 may comprise any suitable display unit for displaying information appropriate for a mobile computing device. I/O device 706 may comprise any suitable I/O device for entering information into a mobile computing device. Examples for I/O device 706 may include an alphanumeric keyboard, a numeric keypad, a touch pad, input keys, buttons, switches, rocker switches, microphones, speakers, voice recognition device and software, and so forth. Information also may be entered into device 700 by way of microphone. Such information may be digitized by a voice recognition device. The embodiments are not limited in this context.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits (IC), application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Whether hardware elements and/or software elements are used may vary from one embodiment to the next in accordance with any number of factors, such as desired computational rate, power levels, heat tolerances, processing cycle budget, input data rates, output data rates, memory resources, data bus speeds, and other design or performance constraints.

Some embodiments may be implemented, for example, using a machine-readable medium or article which may store an instruction or a set of instructions that, if executed by a machine, may cause the machine to perform a method and/or operations in accordance with an embodiment. Such a machine may include, for example, any suitable processing platform, computing platform, computing device, processing device, computing system, processing system, computer, processor, or the like, and may be implemented using any suitable combination of hardware and software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or rewriteable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of executable code implemented using any suitable high-level, low-level, object-oriented, visual, compiled, and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers, or other such information storage, transmission, or displays. The embodiments are not limited in this context.

Further Example Embodiments

The following examples pertain to further embodiments, from which numerous permutations and configurations will be apparent.

Example 1 is a method of using a tactile display to display an image, the method including: analyzing the image to be displayed by the tactile display; and utilizing data from the analysis, adjusting an actuator element of the tactile display so that an image displayed by the tactile display exhibits an enhanced image attribute as compared to the image initially to be displayed by the tactile display.

Example 2 includes the subject matter of any of Examples 1 and 3-12, wherein analyzing the image to be displayed by the tactile display includes: detecting object edges within the image to be displayed.

Example 3 includes the subject matter of any of Examples 1-2 and 4-12, wherein analyzing the image to be displayed by the tactile display includes: converting the image to be displayed to a black and white image; and inverting the resultant black and white image.

Example 4 includes the subject matter of any of Examples 1-3 and 5-12, wherein analyzing the image to be displayed by the tactile display further includes: calculating darkness intensity values across the resultant black and white, inverted image.

Example 5 includes the subject matter of any of Examples 1-4 and 6-12, wherein adjusting the actuator element of the tactile display includes: adjusting a Z-height of the actuator element with respect to a display surface of the tactile display.

Example 6 includes the subject matter of Example 5, wherein adjusting the actuator element of the tactile display further includes: adjusting the actuator element in at least one of an X-dimension and/or Y-dimension with respect to the display surface of the tactile display.

Example 7 includes the subject matter of any of Examples 1-6 and 8-12, wherein adjusting the actuator element of the tactile display includes: adjusting a Z-height of the actuator element with respect to a display surface of the tactile display from a first thickness at which the actuator element exhibits a first optical transparency to a second thickness at which the actuator element exhibits a second optical transparency different from the first optical transparency.

Example 8 includes the subject matter of any of Examples 1-7 and 9-12, wherein adjusting the actuator element of the tactile display includes: adjusting the actuator element to highlight an object edge detected within the image to be displayed.

Example 9 includes the subject matter of any of Examples 1-8 and 10-12, wherein adjusting the actuator element of the tactile display includes: adjusting the actuator element to shade a region within the image to be displayed.

Example 10 includes the subject matter of any of Examples 1-9 and 11-12, wherein adjusting the actuator element of the tactile display reduces observable glare.

Example 11 includes the subject matter of any of Examples 1-10 and 12, wherein the actuator element of the tactile display is one of a plurality of microelectromechanical systems (MEMS) devices configured into an array, and wherein the array of MEMS devices provides for a 4K ultra high definition (UHD) resolution or higher.

Example 12 includes the subject matter of any of Examples 1-11, wherein the enhanced image attribute pertains to at least one of pixel brightness/intensity, pixel color, edge highlighting, object outlining, effective shading, image contrast, and/or viewing angle.

Example 13 is a computer-readable medium encoded with instructions that, when executed by one or more processors, causes a process for using a tactile display to display an image to be carried out, the process including: analyzing the image to be displayed by the tactile display; and utilizing data from the analysis, adjusting an actuator element of the tactile display so that an image displayed by the tactile display exhibits an enhanced image attribute as compared to the image initially to be displayed by the tactile display.

Example 14 includes the subject matter of any of Examples 13 and 15-24, wherein analyzing the image to be displayed by the tactile display includes: detecting object edges within the image to be displayed.

Example 15 includes the subject matter of any of Examples 13-14 and 16-24, wherein analyzing the image to be displayed by the tactile display includes: converting the image to be displayed to a black and white image; and inverting the resultant black and white image.

Example 16 includes the subject matter of any of Examples 13-15 and 17-24, wherein analyzing the image to be displayed by the tactile display further includes: calculating darkness intensity values across the resultant black and white, inverted image.

Example 17 includes the subject matter of any of Examples 13-16 and 18-24, wherein adjusting the actuator element of the tactile display includes: adjusting a Z-height of the actuator element with respect to a display surface of the tactile display.

Example 18 includes the subject matter of any of Examples 13-17 and 19-24, wherein adjusting the actuator element of the tactile display further includes: adjusting the actuator element in at least one of an X-dimension and/or Y-dimension with respect to the display surface of the tactile display.

Example 19 includes the subject matter of any of Examples 13-18 and 20-24, wherein adjusting the actuator element of the tactile display includes: adjusting a Z-height of the actuator element with respect to a display surface of the tactile display from a first thickness at which the actuator element exhibits a first optical transparency to a second thickness at which the actuator element exhibits a second optical transparency different from the first optical transparency.

Example 20 includes the subject matter of any of Examples 13-19 and 21-24, wherein adjusting the actuator element of the tactile display includes: adjusting the actuator element to highlight an object edge detected within the image to be displayed.

Example 21 includes the subject matter of any of Examples 13-20 and 22-24, wherein adjusting the actuator element of the tactile display includes: adjusting the actuator element to shade a region within the image to be displayed.

Example 22 includes the subject matter of any of Examples 13-21 and 23-24, wherein adjusting the actuator element of the tactile display reduces observable glare.

Example 23 includes the subject matter of any of Examples 13-22 and 24, wherein the actuator element of the tactile display is one of a plurality of microelectromechanical systems (MEMS) devices configured into an array, and wherein the array of MEMS devices provides for a 4K ultra high definition (UHD) resolution or higher.

Example 24 includes the subject matter of any of Examples 13-23, wherein the enhanced image attribute pertains to at least one of pixel brightness/intensity, pixel color, edge highlighting, object outlining, effective shading, image contrast, and/or viewing angle.

Example 25 is a device including: an image analysis module configured to analyze an image to be displayed by a tactile display; and a controller configured to adjust an actuator element of the tactile display based on image analysis data provided by the image analysis module so that an image displayed by the tactile display exhibits an enhanced image attribute as compared to the image initially to be displayed by the tactile display.

Example 26 includes the subject matter of any of Examples 25 and 27-31, wherein the image to be displayed by the tactile display is provided by an image source configured to output an image signal to at least one of the tactile display and/or the image analysis module.

Example 27 includes the subject matter of Example 26, wherein the image source includes at least one of a desktop computer, a laptop/notebook computer, a tablet computer, a mobile phone, a smartphone, a digital versatile disc (DVD) player, a Blu-Ray disc player, a set-top box (STB), a gaming platform, a handheld gaming device, a personal digital assistant (PDA), and/or a media player device.

Example 28 includes the subject matter of any of Examples 25-27 and 29-31, wherein in response to the image analysis data, the controller adjusts a Z-height of the actuator element with respect to a display surface of the tactile display.

Example 29 includes the subject matter of Example 28, wherein in response to the image analysis data, the controller also adjusts the actuator element in at least one of an X-dimension and/or Y-dimension with respect to the display surface of the tactile display.

Example 30 includes the subject matter of any of Examples 25-29 and 31, wherein in response to the image analysis data, the controller adjusts a Z-height of the actuator element with respect to a display surface of the tactile display from a first thickness at which the actuator element exhibits a first optical transparency to a second thickness at which the actuator element exhibits a second optical transparency different from the first optical transparency.

Example 31 includes the subject matter of any of Examples 25-30, wherein the enhanced image attribute pertains to at least one of pixel brightness/intensity, pixel color, edge highlighting, object outlining, effective shading, image contrast, and/or viewing angle.

Example 32 is a system including: a tactile display including: a display surface; and an actuator element operatively coupled with the display surface; a controller configured to control the actuator element; and an image analysis module configured to output image analysis data to the controller; wherein in response to the image analysis data, the controller adjusts a Z-height of the actuator element so as to enhance an image attribute of an image to be displayed by the tactile display.

Example 33 includes the subject matter of any of Examples 32 and 34-48, wherein the actuator element includes a microelectromechanical systems (MEMS) device.

Example 34 includes the subject matter of any of Examples 32-33 and 35-48, wherein the actuator element includes an electrically switched light modulator.

Example 35 includes the subject matter of any of Examples 32-34 and 36-48, wherein the actuator element includes an interferometric modulator element.

Example 36 includes the subject matter of any of Examples 32-35 and 37-48, wherein the actuator element includes a ceramic piezoelectric material.

Example 37 includes the subject matter of any of Examples 32-36 and 38-48, wherein the actuator element includes at least one of lead zirconium titanate ($Pb(Zr_xTi_{1-x})O_3$) and/or zinc oxide (ZnO).

Example 38 includes the subject matter of any of Examples 32-37 and 39-48, wherein the actuator element includes an electroactive polymer (EAP) material.

Example 39 includes the subject matter of any of Examples 32-38 and 40-48, wherein the actuator element is associated with a single pixel of the tactile display.

Example 40 includes the subject matter of any of Examples 32-39 and 41-48, wherein the actuator element is associated with multiple pixels of the tactile display.

Example 41 includes the subject matter of any of Examples 32-40 and 42-48, wherein the actuator element is optically transparent.

Example 42 includes the subject matter of any of Examples 32-41 and 43-48, wherein the actuator element exhibits an optical transparency in the range of about 80-99%.

Example 43 includes the subject matter of any of Examples 32-42 and 44-48, wherein the actuator element is bimodal, having a low state and a high state.

Example 44 includes the subject matter of any of Examples 32-43 and 45-48, wherein the actuator element is multimodal, having a low state, a high state, and at least one intermediate state there between.

Example 45 includes the subject matter of any of Examples 32-44 and 46-48, wherein the tactile display includes a region that is devoid of an actuator element.

Example 46 includes the subject matter of any of Examples 32-45 and 47-48, wherein the tactile display is backlighted.

Example 47 includes the subject matter of any of Examples 32-46 and 48, wherein the system is at least one of a television, a computer monitor, a laptop/notebook computer, a tablet computer, a mobile phone, a smartphone, a personal digital assistant (PDA), and/or a media player device.

Example 48 includes the subject matter of any of Examples 32-47, wherein the enhanced image attribute pertains to at least one of pixel brightness/intensity, pixel color, edge highlighting, object outlining, effective shading, image contrast, and/or viewing angle.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A method of displaying an image with a tactile electronic visual display, the method comprising:

adjusting an actuator element of the tactile electronic visual display, the actuator element including an unactuated state such that the actuator element is adjustable along an axis relative to the unactuated state in a first direction in which the actuator element exhibits a first optical transparency and in a second direction different from the first direction in which the actuator element exhibits a second optical transparency, the actuator element is associated with at least one pixel of the tactile electronic visual display, wherein the adjusted actuator element manipulates presentation of the displayed image such that observable glare is reduced by decreasing an intensity of light reflected from the tactile electronic visual display by adjusting the actuator element relative to the unactuated state in one of the first direction and the second direction to change optical absorption characteristics of the actuator element.

2. The method of claim 1, further comprising:

analyzing the image to be displayed by the tactile electronic visual display to detect object edges within the image to be displayed and determine image analysis data;

adjusting, in response to the determined image analysis data, the actuator element relative to the unactuated state to increase image contrast of the displayed image; and wherein the pixel the tactile electronic visual display associated with the actuator element corresponds to at least one object edge detected in the displayed image.

3. The method of claim 1, further comprising:

analyzing the image to be displayed by the tactile electronic visual display to locate the at least one boundary between the light region and the dark region within the image, wherein analyzing the image comprises converting the image to be displayed to a black and white image, inverting the resultant black and white image, and calculating darkness intensity values across the resultant black and white, inverted image; and wherein the at least one boundary of the image corresponds with a dark region of the black and white, inverted image.

4. The method of claim 1, wherein adjusting the actuator element of the tactile electronic visual display comprises:

adjusting a height of the actuator element along a Z-axis relative to the unactuated state of the actuator element.

5. The method of claim 4, wherein adjusting the actuator element of the tactile electronic visual display further comprises:

adjusting the actuator element in at least one of an X-dimension and a Y-dimension with respect to the unactuated state of the actuator.

6. The method of claim 1, wherein adjusting the actuator element of the tactile electronic visual display comprises:

adjusting the actuator element along a Z-axis relative to the unactuated state of the actuator element to adjust a Z-height of the actuator element from a first actuator thickness at which the actuator element exhibits the first optical transparency to a second actuator thickness at which the actuator element exhibits the second optical transparency, such that the second optical transparency is different from the first optical transparency.

7. The method of claim 1, wherein the displayed image exhibits an enhanced image attribute by changing a characteristic of the actuator element, the enhanced image attribute pertains to at least one of pixel brightness/intensity, pixel color, edge highlighting, object outlining, effective shading, image contrast, and viewing angle.

8. A non-transitory computer-readable medium encoded with instructions that, when executed by one or more processors, causes a process for displaying an image with a tactile electronic visual display to be carried out, the process comprising:

adjusting an actuator element of the tactile electronic visual display, the actuator element including an unactuated state such that the actuator element is adjustable along an axis relative to the unactuated state in a first direction in which the actuator element exhibits a first optical transparency and in a second direction different from the first direction in which the actuator element exhibits a second optical transparency, the actuator element is associated with at least one pixel of the tactile electronic visual display, wherein the adjusted actuator element manipulates presentation of the displayed image such that observable glare is reduced by decreasing an intensity of light reflected from the tactile electronic visual display by adjusting the actuator element relative to the unactuated state in one of the first direction and the second direction to change optical absorption characteristics of the actuator element.

9. The computer-readable medium of claim 8, further comprising:

analyzing the image to be displayed by the tactile electronic visual display to detect object edges within the image to be displayed and determine image analysis data;

adjusting, in response determined the image analysis data, the actuator element relative to the unactuated state to increase image contrast of the displayed image; and wherein the pixel of the tactile electronic visual display associated with the actuator element corresponds to at least one object edge detected in the displayed image.

10. The computer-readable medium of claim 8, further comprising:

analyzing the image to be displayed by the tactile electronic visual display to locate the at least one boundary between the light region and the dark region within the image, wherein analyzing the image comprises converting the image to be displayed to a black and white image, inverting the resultant black and white image, and calculating darkness intensity values across the resultant black and white, inverted image; and wherein the at least one boundary of the image corresponds with a dark region of the black and white, inverted image.

11. The computer-readable medium of claim 8, wherein adjusting the actuator element of the tactile electronic visual display comprises:

adjusting a height of the actuator element along a Z-axis relative to the unactuated state of the actuator element.

12. The computer-readable medium of claim 11, wherein adjusting the actuator element of the tactile electronic visual display further comprises:

adjusting the actuator element in at least one of an X-dimension and a Y-dimension with respect to the unactuated state of the actuator element.

13. The computer-readable medium of claim 8, wherein adjusting the actuator element of the tactile electronic visual display comprises:

adjusting the actuator element along a Z-axis relative to the unactuated state of the actuator element to adjust a Z-height of the actuator element from a first actuator thickness at which the actuator element exhibits the first optical transparency to a second actuator thickness at which the actuator element exhibits the second optical transparency, such that the second optical transparency is different from the first optical transparency.

14. The computer-readable medium of claim 8, wherein the displayed image exhibits an enhanced image attribute by changing a characteristic of the actuator element, the enhanced image attribute pertains to at least one of pixel brightness/intensity, pixel color, edge highlighting, object outlining, effective shading, image contrast, and viewing angle.

15. A device comprising:

a controller configured to adjust an actuator element of a tactile electronic visual display, the actuator element including an unactuated state such that the actuator element is adjustable along an axis relative to the unactuated state in a first direction in which the actuator element exhibits a first optical transparency and in a second direction different from the first direction in which the actuator element exhibits a second optical transparency, the actuator element is associated with at least one pixel of the tactile electronic visual display, wherein the adjusted actuator element manipulates presentation of an image displayed with the tactile electronic visual display such that observable glare is reduced by decreasing an intensity of light reflected from the tactile electronic visual display by adjusting the actuator element relative to the unactuated state in one of the first direction and the second direction to change optical absorption characteristics of the actuator element.

16. The device of claim 15, further comprising:

an image analysis module configured to analyze the image to locate at least one boundary between a light region and a dark region within the image and provide image analysis data to the controller;

wherein in response to receiving the image analysis data, the controller adjusts a height of the actuator element along a Z-axis relative to the unactuated state of the actuator element to increase image contrast of the displayed image; and wherein the at least one pixel of the tactile electronic visual display associated with the actuator element is located along the at least one boundary between a light region and a dark region within the image.

17. The device of claim 16, wherein in response to the image analysis data, the controller also adjusts the actuator element in at least one of an X-dimension and a Y-dimension with respect to the unactuated state of the actuator element.

18. The device of claim 15, wherein in response to the image analysis data, the controller adjusts the actuator element along a Z-axis relative to the unactuated state of the actuator element to adjust a Z-height of the actuator element from a first actuator thickness at which the actuator element exhibits the first optical transparency to a second actuator thickness at which the actuator element exhibits the second optical transparency, such that the second optical transparency is different from the first optical transparency.

19. The device of claim 15, wherein the displayed image exhibits an enhanced image attribute by changing a characteristic of the actuator element, the enhanced image attribute pertains to at least one of pixel brightness/intensity, pixel color, edge highlighting, object outlining, effective shading, image contrast, and viewing angle.

20. A system comprising:

a tactile electronic visual display configured to display an image and including a display surface, an actuator element operatively coupled with the display surface, a controller configured to control the actuator element; and the controller adjusts the actuator element, the actuator element including an unactuated state such that the actuator element is adjustable along an axis relative to the unactuated state in a first direction in which the actuator element exhibits a first optical transparency and in a second direction different from the first direction in which the actuator element exhibits a second optical transparency, the actuator element is associated with at least one pixel of the tactile electronic visual display, wherein the adjusted actuator element manipulates presentation of the image displayed by the tactile electronic visual display so as to reduce observable glare by decreasing an intensity of light reflected from the tactile electronic visual display by adjusting the actuator element relative to the unactuated state in one of the first direction and the second direction to change optical absorption characteristics of the actuator element.

21. The system of claim 20, wherein the actuator element comprises at least one of a microelectromechanical systems (MEMS) device, an electrically switched light modulator, and an interferometric modulator element.

22. The system of claim 20, wherein the actuator element comprises at least one of a ceramic piezoelectric material, lead zirconium titanate ($Pb(Zr_xTi_{1-x})O_3$), zinc oxide (ZnO), and an electroactive polymer (EAP) material.

23. The system of claim 20, wherein the actuator element is associated with a single pixel of the tactile electronic visual display.

24. The system of claim 20, further comprising:

an image analysis module configured to analyze the image to locate at least one boundary between a light region and a dark region within the image and provide image analysis data to the controller;

wherein in response to receiving the image analysis data, the controller adjusts the actuator element relative to the unactuated state to enhance image contrast of the image; and wherein the at least one pixel of the tactile electronic visual display associated with the actuator element is located along the at least one boundary between a light region and a dark region within the image.

25. The system of claim 20, wherein the displayed image exhibits an enhanced image attribute by changing a characteristic of the actuator element, the enhanced image attribute pertains to at least one of pixel brightness/intensity, pixel color, edge highlighting, object outlining, effective shading, image contrast, and viewing angle.

* * * * *